US005765770A

United States Patent [19]

Hermanns et al.

[11] Patent Number: 5,765,770

[45] Date of Patent: Jun. 16, 1998

[54] METHOD AND APPARATUS FOR GRASPING A YARN END ON A CHEESE

[75] Inventors: Ferdinand-Josef Hermanns, Erkelenz; Robert Hartel, Aachen; Herbert Henze, Mönchengladbach; Karl-Josef Höhne, Köln; Herbert Knors, Mönchengladbach; Dietmar Engelhardt, Mönchengladbach; Wilhelm Zitzen, Mönchengladbach; Manfred Veyes, Mönchengladbach; Herbert Merkens, Erkelenz; Wolfram Weissenfels, Mönchengladbach; Hermann Rütten, Viersen; Dirk Jägers, Mönchengladbach; Berndt Pommer, Mönchengladbach, all of Germany

[73] Assignee: W. Schlafhorst AG & Co., Moenchengladbach, Germany

[21] Appl. No.: 508,709

[22] Filed: Jul. 28, 1995

Related U.S. Application Data

[63] Continuation-in-part of Ser. No. 88,819, Jul. 8, 1993, abandoned.

[30] Foreign Application Priority Data

Jul. 8, 1992 [DE] Germany ..... 42 22 377.6

[51] Int. Cl.[6] ..... B65H 69/04; B65H 63/00; D01H 13/26

[52] U.S. Cl. ..... 242/35.6 E; 57/263; 242/36

[58] Field of Search ..... 242/35.6 E, 35.6 R, 242/36; 57/263

[56] References Cited

U.S. PATENT DOCUMENTS

| | | | |
|---|---|---|---|
| 3,728,550 | 4/1973 | Cleland et al. | 242/35.6 E |
| 4,535,945 | 8/1985 | Rohner et al. | 242/35.6 R |
| 4,828,191 | 5/1989 | Rüge et al. | 242/36 X |
| 4,844,358 | 7/1989 | Kamp | 242/35.5 R |
| 4,958,779 | 9/1990 | Colli et al. | 242/35.6 R |
| 4,964,581 | 10/1990 | Colli et al. | 242/35.6 R |
| 4,964,582 | 10/1990 | Hermanns et al. | 242/36 |
| 4,986,482 | 1/1991 | Okayama | 242/35.6 R |
| 5,004,171 | 4/1991 | Colli et al. | 242/35.6 R |
| 5,170,953 | 12/1992 | Stahlecker | 242/35.6 E X |
| 5,337,550 | 8/1994 | Mayer et al. | 57/263 |
| 5,426,929 | 6/1995 | Schwalm et al. | 242/35.6 E X |

FOREIGN PATENT DOCUMENTS

| | | |
|---|---|---|
| 3225379 | 1/1984 | Germany . |
| 3937731 | 8/1990 | Germany . |
| 4032617 | 4/1992 | Germany . |
| 3904065 | 4/1993 | Germany . |

*Primary Examiner*—Michael Mansen

*Attorney, Agent, or Firm*—Laurence A. Greenberg; Herbert L. Lerner

[57] ABSTRACT

A textile machine includes a cheese or cross-wound bobbin winder with winding stations each having a creel for holding a cheese, a reversible rotary cheese drive, a suction nozzle and a swivel drive for swivelling the suction nozzle to the jacket surface of the cheese. A method for grasping a yarn end resting on the cheese includes adjusting a search time during which the inward-swivelled suction nozzle is positioned at the reverse-rotating cheese, in dependence on the instantaneous diameter of the cheese, and on the reverse speed of the rotary cheese drive, which is kept constant over the entire search time. An apparatus for grasping a yarn end resting on the cheese includes a control device, control lines connecting the reversible rotary cheese drive and the swivel drive of the suction nozzle to the control device, and measured value pickups at each winding station for recognizing a predetermined number of cheese revolutions, for detecting the speed of the rotary cheese drive, and for recognizing the swivelled position of the suction nozzle.

19 Claims, 1 Drawing Sheet

METHOD AND APPARATUS FOR GRASPING A YARN END ON A CHEESE

CROSS-REFERENCE TO RELATED APPLICATION

This application is a continuation-in-part of application Ser. No. 08/088,819, filed Jul. 8, 1993 now abandoned.

BACKGROUND OF THE INVENTION

1. Field of the Invention

The invention relates to a method and an apparatus for grasping a yarn end resting on a cheese, cross-wound bobbin or package, in which the cheese is held in a creel of a cheese winder of a textile machine, and the cheese winder has a reversible rotary cheese drive and a suction nozzle that can be swivelled into the region of the jacket surface of the cheese by means of a swivel drive.

Spinning cops delivered from the spinning factory and containing only small quantities of yarn are known to be rewound on cheese winders to make cheeses or cheese packages. In that rewinding process, the yarns are also cleaned, that is thick or thin points in the yarns are cut out. The resultant yarn ends (bottom yarn/top yarn) are then intermingled in a splicer to make a knotless yarn connection. The yarn ends are introduced into a channel of a prism by a gripper tube (for the bottom yarn) and a suction nozzle (for the top yarn) and are pneumatically spliced together there. The freshly spun yarn in spinning machines corresponds to the bottom yarn coming from the spinning cop in automatic cheese winders.

It is known for the suction nozzle, which is parked in a lower outset position during the normal rewinding process, to be swivelled inward into an upper yarn end search position at the beginning of the splicing process, and for the cheese then to be rotated in reverse by means of a reversible rotary cheese drive. Typically in that known method, the yarn end resting on the cheese is presented to the suction nozzle three times, and the search time during which the suction nozzle remains in front of the periphery of the cheese is constant. Since the search time is constant, the reverse speed of the rotary cheese drive is adapted to the current package diameter. Although that method employed in the industry does produce a constant angular velocity of the cheeses, even with different package diameters, it nevertheless has disadvantages.

It has been conventional in the art to offer the yarn end to the suction nozzle three times. The search time is thereby held constant, and the reverse speed of the yarn guide drum is adapted to the respective cheese diameter. Such a process theoretically results in a constant angular velocity of the cheese, so that the yarn end is presented to the suction nozzle three times independently of the cheese diameter. The surface speed (the velocity vector of the rotating bobbin at the cheese surface) naturally increases with an increasing cheese diameter (the velocity is the product of the radius and the angular velocity).

This leads to severe problems. For instance, the rotary cheese drive does not possess sufficient dynamic strength in order to accelerate a cheese with a large diameter within the predetermined, relatively short search time of the suction nozzle. Furthermore, the suction nozzle is enabled to grasp the yarn end only within a relatively narrow range of reverse speeds, and the danger exists that the yarn end may not be grasped by the suction nozzle even if it is presented three times.

U.S. Pat. No. 5,004,171 to Colli et al. pertains to a method and an apparatus for improving the yarn connecting process in a winding station. That prior art disclosure is not directed to yarn end search operations as much as it is interested in the chronological sequence of the sequential process steps. For that purpose, Colli et al. divide their process into two portions and a pause which is interjected between the two portions of the sequence. Once the winding of a new bobbin has been started and the braking time T has been reset to zero, the program queries for a yarn discontinuity. When such a yarn break is detected, the braking operation is initiated and the timer is started. When, in the next query, the time $T_{n-1}$ is greater than any of a number of limits, then a waiting period is interjected. Subsequently, the program proceeds with the second portion of the sequence. There is very little information in Colli et al. with regard to the particulars surrounding the second query, namely between the step entitled "read $t_{on}$ braking start" and the step entitled "operate joining device". In other words, Colli et al. take into consideration that the kinetic energy of a running bobbin becomes greater with an increasing cheese diameter, which necessarily increases the time necessary for braking the cheese down to standstill. It is only the point at which the joining operation is started which depends on the necessary braking time, which of course, is proportional to the diameter. Colli et al. therefore provide information with regard to an optimal braking operation, but they do not provide any solutions with regard to the ensuing operation, namely the yarn search operation.

SUMMARY OF THE INVENTION

It is accordingly an object of the invention to provide a method and an apparatus for grasping a yarn end of a cheese, which overcome the hereinafore-mentioned disadvantages of the heretofore-known methods and devices of this general type and increase the certainty with which the top yarn will be grasped.

With the foregoing and other objects in view there is provided, in accordance with the invention, a method for grasping a yarn end resting on a cheese or cross-wound bobbin, which comprises: holding a cheese in a creel of a cheese winder of a textile machine; determining an instantaneous diameter of the cheese; swiveling a suction nozzle with a swivel drive into an inward-swivelled position in immediate vicinity of a jacket surface of the cheese; defining a surface speed of the cheese which assures optimal grasping of the yarn end of a top yarn by the suction nozzle, adjusting a search time in dependence on the instantaneous diameter of the cheese and on the defined surface speed; driving the cheese in reverse with a reversible rotary cheese drive of the cheese winder at the defined surface speed, and maintaining the surface speed constant during the entire search time; and grasping the top yarn with the suction nozzle during the search time.

In other words, the method according to this invention operates with a variable search time of the suction nozzle, in which the search time is adapted to the instantaneous diameter of the cheese.

The instantaneous diameter of the cheese may be determined by way of a calcuation from available variables, by way of measurement with a sensor such as a light gate, by querying the amount of yarn which has been wound onto the bobbin, or by determining the diameter from the angular position of the creel holding the bobbin.

The reverse winding speed is maintained at a constant level and that speed is adjusted in a preliminary operation such that the cheese surface passes by the suction nozzle at an optimal speed. The optimization is towards the pickup capacity of the suction nozzle, which lies within a relatively narrow range.

With the objects of the invention in view, there is also provided, in a textile machine including a cheese winder with winding stations each having a creel for holding a cheese or cross-wound bobbin, an apparatus for grasping a yarn end resting on the cheese, comprising: a reversible rotary cheese drive, a suction nozzle, and a swivel drive for swivelling the suction nozzle into a region of a jacket surface of the cheese, a control device, control lines connecting the reversible rotary cheese drive and the swivel drive to the control device, and measured value pickups at each of the winding stations for recognizing a predetermined number of cheese revolutions, for detecting a speed of the rotary cheese drive, and for recognizing a swivelled position of the suction nozzle.

Due to the constant reverse speed, the operating conditions for the suction nozzle are improved considerably, and there is assurance that the suction nozzle can grasp the yarn end resting on the cheese within the relatively narrow optimal reverse speed range. This optimal reverse speed range has until now often not been reached when package diameters are small, while with large package diameters, conversely, it is easily exceeded.

The term "constant reverse speed" thereby refers to an angular velocity which is first defined (and adjusted) as a function of the instantaneous yarn package diameter (the cheese diameter) and various other parameters. The various other parameters are empirically determined and they include yarn information such as thickness, material, strength, and the like, climatic information such as humidity, temperature and the like, etc.. Once the optimal reverse speed has been defined, the winder is driven at the reverse speed which leads to that defined, optimal speed of the jacket surface of the yarn package.

In accordance with another mode of the invention, there is provided a method which comprises adapting the search time during which the inward-swivelled suction nozzle remains in position in front of the cheese to the particular situation at the winding station through a control device. The search time is oriented substantially to the instantaneous diameter of the cheese. Since the rotary cheese drive is driven at constant reverse speed which is optimal for the yarn end pickup by the suction nozzle, the search time for large package diameters is correspondingly longer than for small package diameters.

In accordance with a further mode of the invention, there is provided a method which comprises making the search time dependent on the number of cheese revolutions being selected, or in other words the number of attempts that the suction nozzle is allowed until it can engage the end of the top yarn.

By adjusting the number of cheese revolutions that are executed during the search time, a limitation is made in the quantity of yarn unwound from the cheese during the reverse travel. At maximum, for instance if the suction nozzle has already grasped the yarn end on the first revolution and the selected number of cheese revolutions was three, this yarn quantity then amounts to a maximum of three times the instantaneous package circumference.

In accordance with an added mode of the invention, there is provided a method which comprises detecting each of the number of cheese revolutions in reverse travel, the reverse speed of the rotary cheese drive, and the swivelled position of the suction nozzle with a respective measured value transducer.

In accordance with an additional feature of the invention, the measured value transducers are connected through signal lines to a control device that processes the measured values obtained and triggers the rotary cheese drive or the swivel drive accordingly through control lines.

In accordance with yet another mode of the invention, there is provided a method which comprises adapting the reverse speed of the rotary cheese drive to the speed at which the suction nozzle is lowered, while the suction nozzle is being swivelled away from the yarn end search position to the yarn splicing position. In this way, proper top yarn transfer without excessive yarn losses is possible.

In accordance with yet a further feature of the invention, the length of the top yarn unwound from the cheese is selected in such a way that it is slightly greater than the distance between the cheese and the splicer.

In accordance with yet an added feature of the invention, there is provided a sensor disposed in the suction nozzle or in the region of the suction nozzle that records the presence of the top yarn being grasped. From the known distance between this sensor and the cheese, it is relatively simple to determine the length of the unwound top yarn and to adjust it, for instance by accordingly turning the cheese in reverse.

In particular, the above-described methods avert overly scanty dimensioning of the yarn quantity that is needed for splicing and is supplied upon reverse travel of the cheese when the package diameters are small and they avoid excess yarn waste when package diameters are large.

The method according to the invention, with a constant reverse speed of the rotary cheese drive over the entire search time, has the overall result of assuring that the optimal conditions for grasping the top yarn are created at any moment in the search time. On one hand, this provides maximum security that the suction nozzle will grasp the yarn, and on the other hand yarn consumption is minimized.

Other features which are considered as characteristic for the invention are set forth in the appended claims.

Although the invention is illustrated and described herein as embodied in a method and an apparatus for grasping a yarn end of a cheese, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The drawing is a fragmentary, diagrammatic, perspective view of a winding station of an automatic cheese winder, in which a suction nozzle for engaging an end of a top yarn is shown on one hand in an upper yarn search position, and on the other hand (in phantom) in a lower parking position.

DESCRIPTION OF THE PREFERRED EMBODIMENTS

Figure 1:
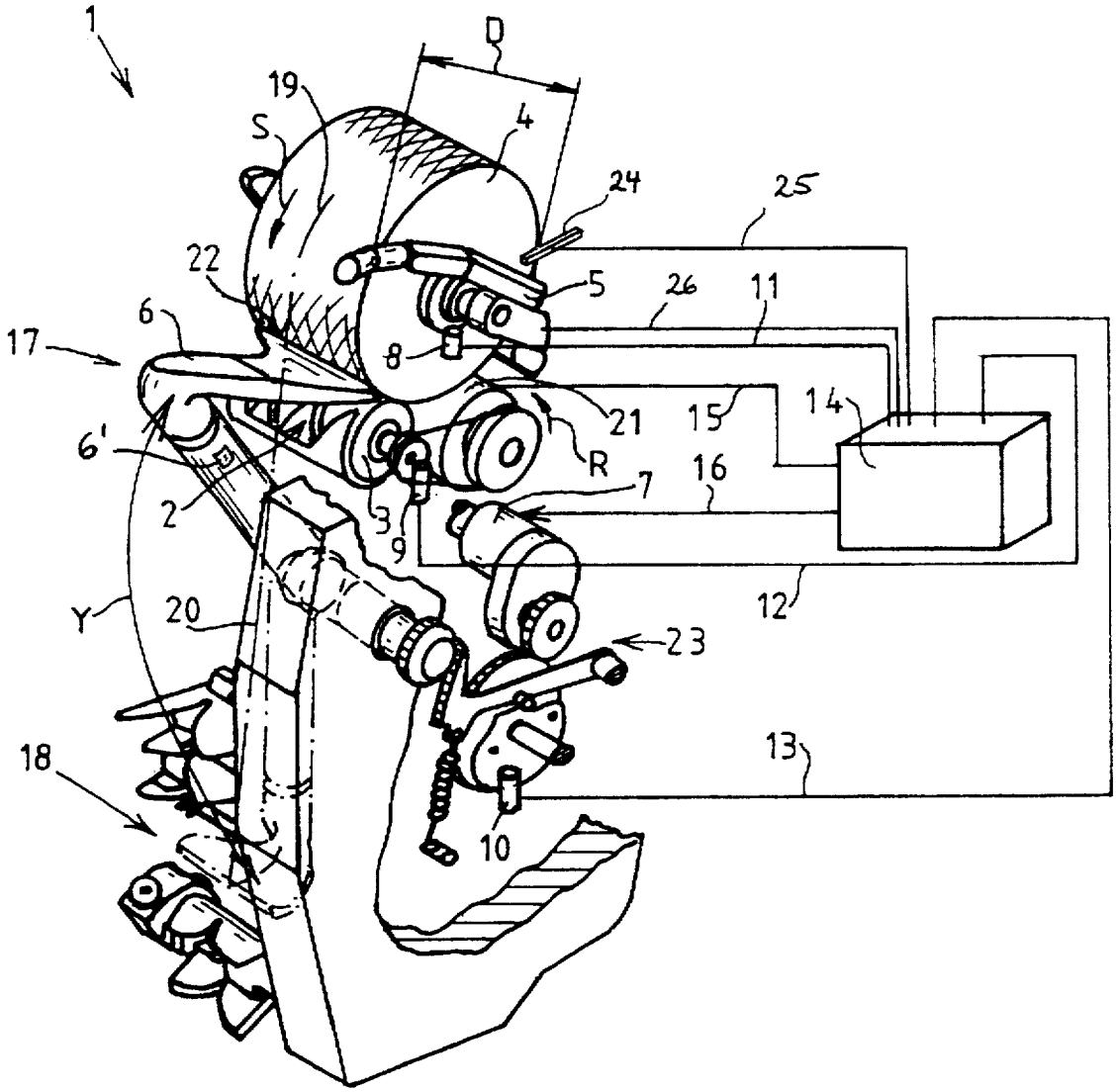

Referring now to the single figure of the drawing in detail, there is seen an upper part of a winding station 1 of an automatic cheese winder, which itself is known per se and is therefore not shown in further detail. An end 19 of a so-called top yarn 20 is shown symbolically on a cheese 4. The cheese 4 rests with its outer layer of yarn on a rotary cheese drive 2. In the present case, this rotary cheese drive 2 includes a yarn guide drum 3, which is acted upon by a reversible yarn guide drum drive 21.

Measured value pickups 8 and 9 are respectively disposed both in the region of a creel 5 and on the rotary cheese drive 2 or the yarn guide drum 3 of the yarn guide drum drive 21. The measured value pickups 8 and 9 are connected to a control device 14 over respective signal lines 11 and 12.

The winding station 1 also has a suction nozzle 6, which can be swivelled out of a parking position 18 into a yarn end engaging position 17, in order to engage an end 19 of the top yarn 20. In the yarn end engaging position 17, the suction nozzle 6 rests with an elongated suction opening 22 close to the periphery of the cheese 4. Swiveling of the suction nozzle 6 between the positions 17 and 18 is carried out by means of a swivel drive 7. The swiveling positions are detected by a measured value pickup 10 disposed in the region of a swivel device 23 or of the swivel drive 7 and are carried on to the control device 14 over a signal line 13. A sensor 6' in the suction nozzle 6 or in the region of the suction nozzle 6 records grasping of the top yarn 20.

Both the reversible yarn guide drum drive 21 and the swivel drive 7 are connected to the control device 14, through respective control lines 15, 16.

The instantaneous diameter of the cheese may be calculated by a method which is known from the prior art and described, for example, in U.S. Pat. No. 4,964,582 to Hermanns et al., which herein incorporated by reference. The diameter of the cross-wound bobbin is calculated in real-time by the control device. The necessary measurement values are detected and delivered from the pickups 8 and 9. The diameter d of the drive drum 21 (a known parameter) multiplied by the angular velocity $\Omega_d$ of the drive drum equals the diameter D of the cheese multiplied by the angular velocity $\Omega_c$ of the cheese. Accordingly, this leads to the simple equation $$D = \frac{d \times \Omega_d}{\Omega_c}$$

The angular velocity of the drive drum is measured via the transducer 8 and the angular velocity of the cheese is measured via the transducer 9, and the signal lines 11 and 12, respectively, continuously feed the measured data to the control device 14.

With reference to alternative embodiments, the instantaneous diameter of the cheese may also be determined by direct measurements: For instance, the instantaneous diameter of the cheese can be measured with a sensor 24, which may be embodied as a light gate, a light gate array, or a distance sensor aimed perpendicularly towards the peripheral surface of the cheese package. The corresponding signal is sent to the processing control device 14 through a line 25.

As a further alternative, the relative position of the creel holder may be ascertained, again with a sensor, and the associated signal is then fed to the control device 14 through a line 26. From the additional information stored in the control device, namely the length of the pivoting creel holder, and the measured value, the radius and the diameter of the cheese package may be determined.

In a final alternative embodiment, the yarn may be continuously measured as it is being wound onto the cross-wound bobbin. The diameter of the cheese is then easily determined from the measured length together with the known parameters regarding the yarn thickness, or an empirically defined characteristic curve which associates the length of wound-on yarn with the diameter of yarn package.

The reverse rotation of the cheese is defined by the diameter thereof. In other words, the cheese is rotated through three full revolutions, for instance, and the speed of rotation (held constant during that rotation and very accurately defined for assuring optimal grasping) defines the length of time during which the suction nozzle is in approach search. The search time, i.e. the time span during which the suction nozzle remains in the vicinity of the cheese surface, is directly proportional to the instantaneous cheese diameter. This defines the search time. With an increasing cheese diameter, the time during which the suction nozzle is active at the cheese surface increases as well. That search time, however, is also dependent on the predetermined angular speed of the drive drum.

The optimal speed is determined purely empirically and it depends on various factors, including the yarn material, the yarn strength, climatic environments, etc.. Once the optimal speed has been determined, the cheese is rewound at that speed which is maintained constant. Accordingly, the invention uses a variable search time of the suction nozzle in dependence on the instantaneous cheese diameter.

FUNCTION OF THE APPARATUS

During a normal winding process, the suction nozzle 6 is in the parking position 18, and the cheese 4 travels in a winding direction S.

There may be an interruption in the travel of the yarn to be wound up, whether in order for flaws in the yarn to be cut out, or if the cop to be rewound runs empty, or if the yarn breaks. If an interruption occurs, then the control device 14 first causes the rotary cheese drive 2, or in the present case the yarn guide drum 3 and the yarn guide drum drive 21, to be braked, and the suction nozzle 6 is swivelled from the parking position 18 into the yarn end engaging or search position 17 by activation of the swivel drive 7. The control device 14 also turns on suction at the suction nozzle and switches the yarn guide drum drive 21 into a reverse direction R at a constant speed. This constant reverse travel direction R is maintained until the measured value pickup 8 disposed on the creel 5 reports over the signal line 11 to the control device 14 that a predetermined number n of cheese revolutions, preferably three, has been executed.

Next, the swivel drive or motor 7 is activated by the control device 14 over the control line 16, so that the suction nozzle 6 is swivelled away from the yarn end search position 17 into the yarn splicing position 18 and in the process inserts the top yarn 20 into a channel of a non-illustrated pneumatic splicer. The swiveling direction Y of the suction nozzle 6 is recorded through the measured value pickup 10 in the region of the swivel device 23 or the swivel drive 7 and is carried on to the control device 14 over the signal line 13.

The speed of the lowering movement of the suction nozzle 6 and the reverse speed of the yarn guide drum drive 21 are adapted to one another exactly. The length of the unwound top yarn 20 is preferably somewhat greater than the distance between the cheese and the splicer.

Through the use of the above-described method and the apparatus for performing this method, the process of searching for the end of a top yarn resting on a cheese and inserting this top yarn into a pneumatic splicer is decisively improved. On one hand, the method of the apparatus considerably increases the certainty with which the suction nozzle will grasp the yarn and on the other hand, it avoids unnecessary yarn losses, which were heretofore quite common especially with large package diameters D.

We claim:

1. A method for grasping a yarn end resting on a cheese or cross-wound bobbin, which comprises:

holding a cheese in a creel of a cheese winder of a textile machine;

determining an instantaneous diameter of the cheese;

swiveling a suction nozzle with a swivel drive into an inward-swivelled position in immediate vicinity of a jacket surface of the cheese;

defining a surface speed of the cheese which assures optimal grasping of the yarn end of a top yarn by the suction nozzle, adjusting a search time in dependence on the instantaneous diameter of the cheese and on the defined surface speed;

driving the cheese in reverse with a reversible rotary cheese drive of the cheese winder at the defined surface speed, and maintaining the surface speed constant during the entire search time; and grasping the top yarn with the suction nozzle during the search time.

2. The method according to claim 1, which comprises performing the step of adjusting the search time during which the suction nozzle is positioned in the immediate vicinity of the reverse-rotating cheese with a control device which also triggers the swivel drive of the suction nozzle and which triggers the rotary cheese drive.

3. The method according to claim 1, which comprises detecting and counting a number of cheese revolutions during the driving step, and wherein the step of adjusting the search time comprises positioning the inward-swivelled suction nozzle in the immediate vicinity of the reverse-rotating cheese during a predetermined number of cheese revolutions.

4. The method according to claim 1, which comprises carrying out the following steps with a control device in the event that yarn travel in a winding operation is interrupted: prior to the swiveling step, braking the rotary cheese drive; subsequently performing the swiveling step by swiveling the suction nozzle inward to a yarn search position; turning on suction in the suction nozzle; subsequently performing the driving step and counting a number of cheese revolutions; following the grasping step, swiveling the suction nozzle outward to a yarn splicing position after an attainment of a predetermined number of cheese revolutions; and shutting off the rotary cheese drive.

5. The method according to claim 4, which comprises shifting the rotary cheese drive to a reverse speed being adapted to a speed at which the suction nozzle is lowered, during the step of swiveling the suction nozzle outward from the yarn end search position to the yarn splicing position.

6. The method according to claim 5, which comprises, in the driving step, unwinding a top yarn from the cheese having a length being somewhat greater than a distance between the cheese and a splicer.

7. The method according to claim 1, wherein the determining step comprises calculating the instantaneous diameter of the cheese from a diameter of a drive drum of the rotary cheese drive, an angular velocity of the drive drum, and an angular velocity of the cheese.

8. The method according to claim 1, wherein the determining step comprises measuring the instantaneous diameter of the cheese with a sensor.

9. The method according to claim 1, wherein the determining step comprises measuring a relative position of the creel holding the cheese and deducing therefrom the diameter of the cheese.

10. The method according to claim 1, wherein the determining step comprises continuously measuring a length of yarn being wound onto the cheese and ascertaining the instantaneous diameter of the cheese from the length of the yarn wound onto the cheese.

11. In a textile machine with winding stations each having a creel for holding a cheese or cross-wound bobbin, an apparatus for grasping a yarn end resting on the cheese, comprising:

a reversible rotary cheese drive, a suction nozzle, and a swivel drive for swivelling the suction nozzle into an immediate vicinity of a jacket surface of the cheese, a control device, control lines connecting the reversible rotary cheese drive and the swivel drive to said control device, and measured value pickups at each of the winding stations for recognizing a predetermined number of cheese revolutions, for detecting a speed of the rotary cheese drive, and for recognizing a swivelled position of the suction nozzle.

12. The apparatus according to claim 11, wherein the rotary cheese drive is a yarn guide drum with an associated yarn guide drum drive.

13. The apparatus according to claim 12, wherein each of said winding stations have said yarn guide drum adjacent the cheese or crosswound bobbin, said measured value pickup for detecting the speed of the rotary cheese drive is disposed on the yarn guide drum and is connected to said control device through a signal line.

14. The apparatus according to claim 12, wherein each of said winding stations have said yarn guide drum adjacent the cheese or cross-wound bobbin and a yarn guide drum drive, and said measured value pickup for detecting the speed of the rotary cheese drive is disposed on the yarn guide drum drive and is connected to said control device through a signal line.

15. The apparatus according to claim 11, wherein said measured value pickup for recognizing the predetermined number of cheese revolutions is disposed adjacent the creel and is connected to said control device through a signal line.

16. The apparatus according to claim 11, including a swivel device, said measured value pickup for recognizing the swiveled position of the suction nozzle being disposed in the region of said swivel device and being connected to said control device through a signal line.

17. The apparatus according to claim 11, wherein said measured value pickup for recognizing the swiveled position of the suction nozzle is disposed in the region of the swivel drive and is connected to said control device through a signal line.

18. The apparatus according to claim 11, including a sensor disposed in the suction nozzle for recording when a top yarn from the cheese has been grasped by the suction nozzle.

19. The apparatus according to claim 11, including a sensor disposed in the region of the suction nozzle, for recording when a top yarn from the cheese has been grasped by the suction nozzle.

* * * * *